US012203340B2

(12) United States Patent
Vasques

(10) Patent No.: US 12,203,340 B2
(45) Date of Patent: Jan. 21, 2025

(54) DOWNHOLE VALVE DEVICE OF A DOWNHOLE COMPLETION SYSTEM

(71) Applicant: Welltec Manufacturing Center Completions ApS, Esbjerg N (DK)

(72) Inventor: Ricardo Reves Vasques, Zug (CH)

(73) Assignee: Welltec Manufacturing Center Completions ApS, Esbjerg N (DK)

( * ) Notice: Subject to any disclaimer, the term of this patent is extended or adjusted under 35 U.S.C. 154(b) by 0 days.

(21) Appl. No.: 18/067,328

(22) Filed: Dec. 16, 2022

(65) Prior Publication Data

US 2023/0193722 A1 Jun. 22, 2023

(30) Foreign Application Priority Data

Dec. 17, 2021 (EP) ..... 21215758

(51) Int. Cl.
*E21B 34/06* (2006.01)
*E21B 34/14* (2006.01)
*E21B 33/128* (2006.01)

(52) U.S. Cl.
CPC ..... *E21B 34/063* (2013.01); *E21B 34/14* (2013.01); *E21B 33/128* (2013.01)

(58) Field of Classification Search
CPC ..... E21B 34/063; E21B 34/14; E21B 33/128
See application file for complete search history.

(56) References Cited

U.S. PATENT DOCUMENTS

2012/0199398 A1* 8/2012 Davis ..... E21B 7/20 175/57
2015/0129205 A1 5/2015 Hofman et al.
2015/0260012 A1* 9/2015 Themig ..... E21B 34/142 166/317
2016/0298417 A1* 10/2016 Styler ..... E21B 34/063
2017/0096879 A1* 4/2017 Kumar ..... E21B 23/00
2021/0348474 A1* 11/2021 Johnson ..... E21B 43/26

FOREIGN PATENT DOCUMENTS

WO 2014/053062 4/2014
WO 2016/161520 10/2016

OTHER PUBLICATIONS

Extended EP Search Report for EP2125758.0 dated Apr. 22, 2022, 6 pages.

* cited by examiner

*Primary Examiner* — Taras P Bemko
(74) *Attorney, Agent, or Firm* — Nixon & Vanderhye P.C.

(57) ABSTRACT

The present invention relates to a downhole valve device for providing access to a hydrocarbon reservoir, comprising a tubular element having a wall, an inner face and an outer face, the tubular element having a first through-bore and a plurality of second through-bores in the wall extending from the inner face to the outer face, and a sleeve abutting the inner face and being displaceable along the inner face between a first state in which the sleeve covers the first and second through-bores and a second state in which the sleeve uncovers the first and second through-bores, wherein a burst element is arranged in the first through-bore and an acid-dissolvable plug is arranged in each second through-bore. Moreover, the present invention also relates to a downhole completion system for completing a well in low pressure zone and a downhole completion method for completing a well.

15 Claims, 2 Drawing Sheets

DOWNHOLE VALVE DEVICE OF A DOWNHOLE COMPLETION SYSTEM

Figures 1A, 1B, 1C, 1D:
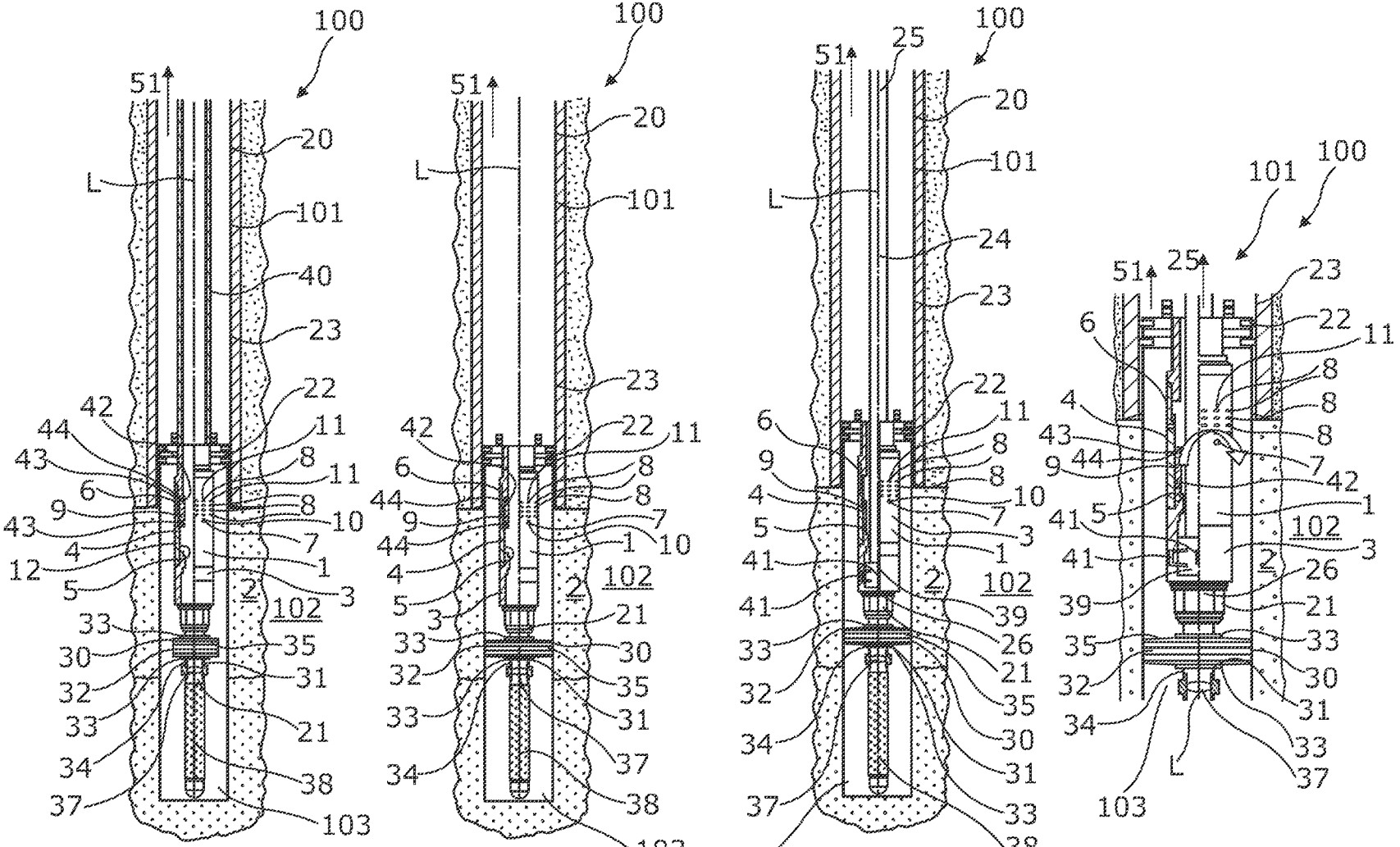

This application claims priority to EP 21215758.0 filed Dec. 17, 2021, the entire contents of which are hereby incorporated by reference.

The present invention relates to a downhole valve device for providing access to a hydro-carbon reservoir. Moreover, the present invention also relates to a downhole completion system for completing a well in a low-pressure zone and a downhole completion method for completing a well.

When drilling a borehole, mud is circulated in order to seal the borehole and provide a first barrier. During a later completion, a liner hanger packer of a liner is set, sealing against the surface casing, the liner hanger packer providing a second barrier. In order to later provide access to the hydrocarbon reservoir, the liner may comprise a frac valve having a sleeve which is activated by a pressure within the liner, providing a pressure difference across the sleeve, breaking a shear pin, the sleeve moving to an open position providing access from the reservoir to within the liner. However, during completion of the well, the pressure often needs to be increased within the liner for setting an isolation packer below the frac valve, for fracking a lower part of the completion or for acid stimulation, and in these situations the frac valve may be unintentionally opened if the pressure surrounding the frac valve unexpectedly decreases, e.g. due to the mud cake being deteriorated opposite a depleted part of the reservoir. Such mud deterioration may occur within a few days from circulating mud and thus after it is decided to install the frac valve.

It is an object of the present invention to wholly or partly overcome the above disadvantages and drawbacks of the prior art. More specifically, it is an object to provide an improved downhole valve device for completing a well, even if experiencing mud deterioration over just a few days.

Additionally, it is an object to provide an improved downhole valve device providing a safe valve for providing access to the reservoir, even if the reservoir has a depleted zone.

The above objects, together with numerous other objects, advantages and features, which will become evident from the below description, are accomplished by a solution in accordance with the present invention by a downhole valve device for providing access to a hydrocarbon reservoir, comprising

- a tubular element having a wall, an inner face and an outer face, the tubular element having a first through-bore and a plurality of second through-bores in the wall extending from the inner face to the outer face, and
- a sleeve abutting the inner face and being displaceable along the inner face between a first state in which the sleeve covers the first and second through-bores and a second state in which the sleeve uncovers the first and second through-bores, wherein a burst element is arranged in the first through-bore and an acid-dissolvable plug is arranged in each second through-bore.

Also, the downhole valve device may have a longitudinal axis, and the first through-bore may be arranged at a distance from the plurality of second through-bores along the longitudinal axis.

In addition, the tubular element may have a groove in which the sleeve is arranged.

Further, the sleeve may be tubular.

Accordingly, the downhole valve device may also be a production flow valve.

Moreover, the downhole valve device may be an inflow valve providing access to the reservoir.

Additionally, the downhole valve device may be a reservoir access downhole valve device.

Furthermore, the downhole valve device may be installed as part of the well tubular metal structure, providing access to the reservoir when in its open position.

Also, the sleeve may comprise a first circumferential groove and a second circumferential groove, with a sealing element being provided in each groove.

Moreover, the first circumferential groove and the second circumferential groove may be arranged with a mutual distance.

In addition, the through-bores in the tubular element may be distributed over an area, the distance between the first circumferential groove and the second circumferential groove being longer along the longitudinal axis of the downhole valve device than the length of the area along the longitudinal axis.

Furthermore, the present invention relates to a downhole completion system for completing a well in a low-pressure zone, comprising:

- a well tubular metal structure, and
- a liner hanger packer connected to the well tubular metal structure and configured to seal and connect the well tubular metal structure within a first casing, wherein the downhole completion system further comprises the above-mentioned downhole valve device, where the tubular element is mounted as part of the well tubular metal structure.

In addition, the downhole completion system may further comprise an annular barrier comprising a tubular part mounted as part of the well tubular metal structure, an expandable metal sleeve being connected at each end with an outer face of the tubular part, defining an expandable space into which fluid is allowed to expand the expandable metal sleeve.

Moreover, the downhole completion system may further comprise a production casing having a first end facing a top of the well and a second end connected with the well tubular metal structure.

In addition, the production casing may comprise a production packer arranged above the liner hanger packer and configured to seal between the production casing and the first casing within the first casing.

Moreover, a production screen may be provided below the downhole valve device.

Additionally, the production casing may comprise a flow device having an opening.

Furthermore, the production casing may comprise control lines for controlling the flow device.

Also, the well tubular metal structure may comprise a closable device.

In addition, the well tubular metal structure may comprise a screen.

Moreover, the second end of the production casing may comprise a sleeve actuator for moving the sleeve of the downhole valve device from the first state to the second state.

Additionally, the sleeve actuator may comprise projecting parts for engaging a groove in the sleeve of the downhole valve device.

Furthermore, the present invention also relates to a downhole completion method for completing a well having a borehole and a first casing installed in an upper part of the borehole in a reservoir having a low-pressure zone by the downhole completion system according to the present invention, comprising

- assembling a well tubular metal structure having a liner hanger packer and a downhole valve device,
- mounting a workstring, such as a drill pipe, with the liner hanger packer,
- inserting the well tubular metal structure into the well through the first casing with the workstring,
- setting the liner hanger packer to seal against the first casing,
- pressurising the well tubular metal structure,
- releasing the workstring and pulling the workstring out of the well,
- displacing the sleeve of the downhole valve device from the first state to the second state, uncovering the burst element and the acid-dissolvable plug(s),
- bursting the burst element by pressurising the well tubular metal structure,
- displacing fluid within at least part of the first casing and within the downhole valve device by means of acid-containing fluid,
- dissolving the acid-dissolvable plug(s), and
- initiating production through the first and second through-bores.

Also, pressurising the well tubular metal structure may expand an expandable metal sleeve of an annular barrier arranged below the downhole valve device.

In addition, the downhole completion method may further comprise inserting a production casing having a first end closest to a top of the well and a second end within the first casing.

Moreover, displacing the sleeve of the downhole valve device from the first state to the second state may be performed by a sleeve actuator arranged in the second end of the production casing.

Additionally, the sleeve actuator and the second end may pass within the downhole valve device, projecting parts of the sleeve actuator engaging a groove in the sleeve.

Further, the sleeve actuator may be moved further down, disengaging the groove of the sleeve.

In addition, before bursting the burst element the method may further comprise displacing a first fluid, such as heavy fluid, by means of a second fluid having a lower density than that of the first fluid, at least within the first casing.

Finally, after displacing the first fluid by means of the second fluid the method may further comprise setting a production packer.

Figure 2D:
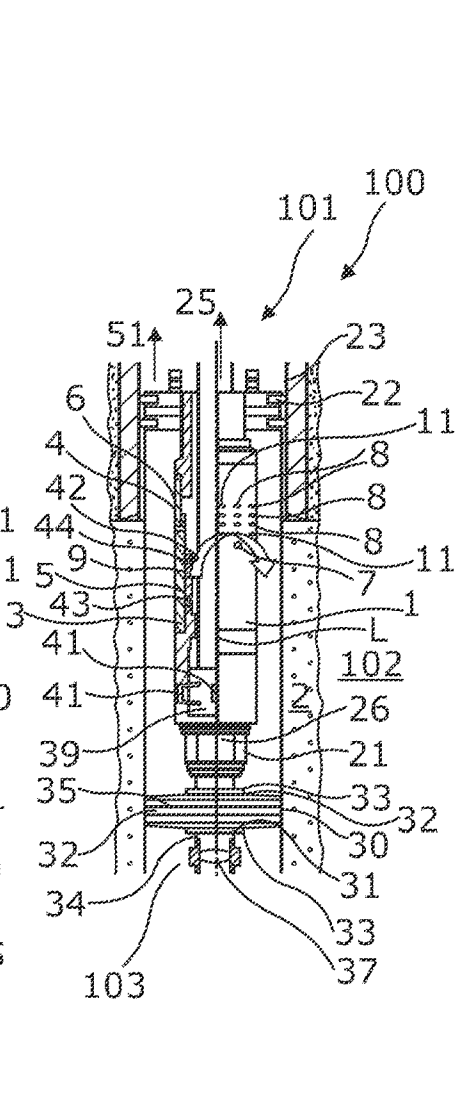
Figure 2C:
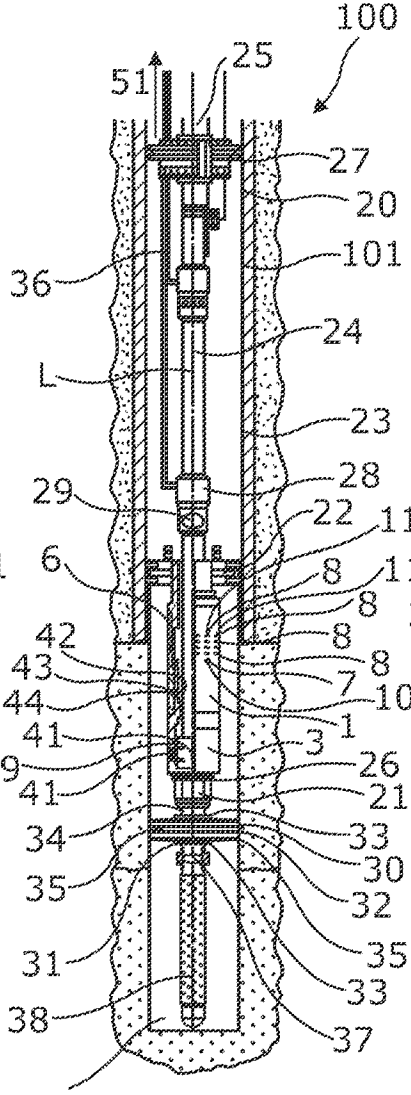
Figure 2B:
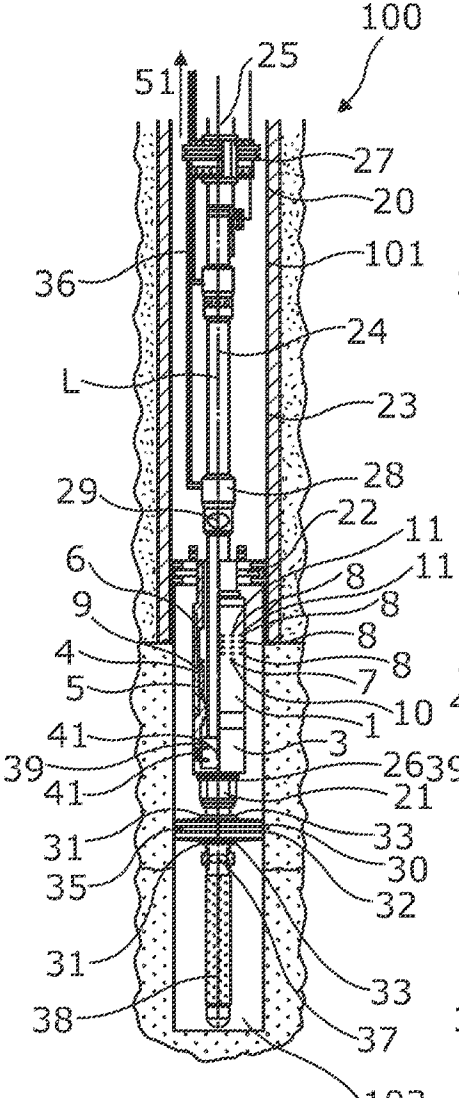
Figure 2A:
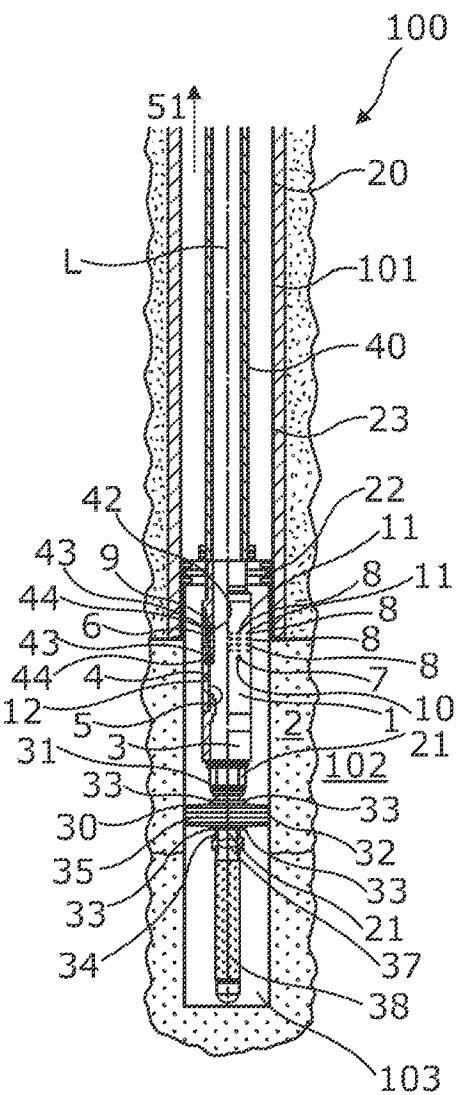

The invention and its many advantages will be described in more detail below with reference to the accompanying schematic drawings, which for the purpose of illustration show some non-limiting embodiments and in which:

FIG. 1A shows a partly cross-sectional view of a downhole completion system having a downhole valve device in its first and closed state and an annular barrier in its unexpanded position, FIG. 1B shows the downhole completion system of FIG. 1A in which the annular barrier has been expanded and the workstring disconnected, FIG. 1C shows the downhole completion system of FIG. 1B in which a production casing has been installed, FIG. 1D shows the downhole completion system of FIG. 1C in which a burst element in a first through-bore has been burst, FIG. 2A shows a partly cross-sectional view of another downhole completion system having a downhole valve device in its first and closed state and an annular barrier in its unexpanded position, FIG. 2B shows the downhole completion system of FIG. 2A in which the annular barrier has been expanded and the workstring disconnected, and a production casing has been installed, FIG. 2C shows the downhole completion system of FIG. 2B in which a production packer of the production casing has been set, and FIG. 2D shows the downhole completion system of FIG. 2C in which a burst element in a first through-bore has been burst.

All the figures are highly schematic and not necessarily to scale, and they show only those parts which are necessary in order to elucidate the invention, other parts being omitted or merely suggested.

FIG. 1A shows a downhole valve device 1 for providing access to a hydrocarbon reservoir 2 when completing a well. The downhole valve device 1 has a longitudinal axis L and is shown in a partly cross-sectional view where to the left of the longitudinal axis L, the downhole valve device 1 is shown in cross-section, and to the right of the longitudinal axis L, the downhole valve device 1 is shown from an outside of the downhole valve device 1. The downhole valve device 1 comprises a tubular element 3 having a wall 4, an inner face 5 and an outer face 6, and the tubular element 3 has a first through-bore 7 and a plurality of second through-bores 8 in the wall 4, the through-bores extending from the inner face 5 to the outer face 6. The downhole valve device 1 further comprises a sleeve 9 abutting the inner face 5 and being displaceable along the inner face 5 between a first state in which the sleeve 9 covers the first and second through-bores 7, 8 and a second state in which the sleeve 9 uncovers the first and second through-bores 7, 8. The downhole valve device 1 is shown in its first and closed state in FIGS. 1A and in its second uncovered state in FIG. 1C. The downhole valve device 1 further comprises a burst element 10 arranged in the first through-bore 7 and a plurality of acid-dissolvable plugs 11, where each acid-dissolvable plug is arranged in one of the second through-bores. The tubular element 3 has a groove 12 in which the sleeve 9 is arranged and slides from the covered first state shown in FIGS. 1A and 1B to the uncovered second state shown in FIGS. 1C and 1D. The sleeve 9 is tubular and slides within the tubular element 3. The sleeve 9 comprises sealing elements 43 in first and second circumferential grooves 44 having a mutual distance sufficient to straddle over all the through-bores 7, 8 in the tubular element 3. The distance between the first and the second circumferential grooves 44 is thus longer than the area in the tubular element 3 having through-bores 7, 8 seen along the longitudinal axis L of the downhole valve device 1 and coincident with the longitudinal axis L of a well tubular metal structure 21.

When completing a well, the borehole wall is covered with mud from the drilling process in order to close off the reservoir 2 so that during the subsequent completion process the pressure is not lost, e.g. if the reservoir 2 has a depleted zone. By having a downhole valve device 1 having both the sleeve 9 covering the burst element 10 and the acid-dissolvable plugs 11, the well has two barriers and thus provides sufficient safety to fulfil standard safety requirements, even if the mud deteriorates and then no longer provides one of the two required barriers. Thus, the downhole valve device 1 provides the two required barriers and will then provide the required safety alone. When the sleeve 9 is moved to its second state in which the sleeve 9 does not cover and seal off the burst element 10 and the acid-dissolvable plugs 11, the downhole valve device 1 still provides one barrier so that in the event that the sleeve 9 is unintentionally moved to the second state, the downhole valve device 1 still provides a safety barrier. By further having both the burst element 10 and the acid-dissolvable plugs 11, flow to the reservoir 2 can be provided by pressurising and bursting the burst element, and then the fluid in the completion can be displaced by means of acid so that the acid-dissolvable plugs can be dissolved. Bursting one burst element 10 does not provide a sufficient flow area, and having further burst elements 10 cannot work since once one burst element 10 has burst, the other burst elements 10 will not burst. In the same way, having only the acid-dissolvable plugs 11 cannot work, as the fluid in the completion cannot be displaced or circulated so that the acid can displace the existing fluid and flow past the acid-dissolvable plugs 11 to dissolve them. Thus, the sleeve 9 covers and seals off the plugs 11 and the burst element 10 so that prior processes, such as acid stimulation or fracking, do not dissolve the plugs 11 before access to the reservoir 2 through the downhole valve device 1 is desired, nor burst the burst element 10 prematurely.

The downhole valve device 1 is thus a zero-rated production flow valve, such as an inflow valve providing access to the reservoir 2, and is thus a reservoir 2 access downhole valve device 1. The downhole valve device 1 is mounted and installed as part of the well tubular metal structure 21 and provides access to the reservoir 2 when in its open position, i.e. in the second state. The downhole valve device 1 may have any position along the well tubular metal structure 21 in the lower completion opposite the zone of the reservoir 2 in which production takes place.

The downhole completion system 100 shown in FIG. 1A for completing a well 101 in a low-pressure zone 102 comprises the well tubular metal structure 21, a liner hanger packer 22 connected to the well tubular metal structure 21 and configured to seal and connect the well tubular metal structure 21 within a first casing 23, and the downhole valve device 1, where the tubular element 3 is mounted as part of the well tubular metal structure 21. The downhole completion system 100 is run into the well by means of a workstring 40, such as a drill pipe, and in FIG. 1A the liner hanger packer 22 has been set to seal between the well tubular metal structure 21 and the first casing 23, which is cemented in place in the borehole at a previous step. Thus, the liner hanger packer 22 provides an annular seal sealing off the lower part from the upper part of the completion. The reservoir 2 may have the zone 102 which has a low pressure as illustrated in FIG. 1A-D. Such low-pressure zone 102 may occur if the reservoir 2 has a depleted area, and such zone may be momentarily sealed off by the mud, but over a few days the mud may deteriorate, and the pressure in the annulus surrounding the downhole valve device 1 then becomes very low so that the downhole valve device 1 experiences a larger differential pressure across the downhole valve device 1 than expected. In such case, the downhole valve device 1 itself provides two barriers—one being the sleeve 9, and the other being the combination of the burst element 10 and the acid-dissolvable plugs 11.

In prior art solutions, the completion is installed with a pressure-activated valve, such as a frac valve, where a sleeve is moved from a closed position sealing off openings to an open position where the sleeve no longer covers the openings, and reservoir 2 access is provided directly by moving the sleeve by way of building up a certain pressure and thus creating a sufficient differential pressure across the sleeve to break a shear pin, and the sleeve is moved. When completing a well, a zone situated below the pressure-activated valve may be fractured by increasing the pressure to a first pressure sufficient to fracture the reservoir 2 further down the well, and the shear pin is calculated and designed to withstand the first pressure. However, such calculation is based on the mud sealing off the low-pressure zone, which may be deteriorating over a few days. If such deterioration occurs, the shear pin, when pressurising the completion to the first pressure, will be exposed to a larger differential pressure than it can withstand, and as a result the valve will open during the fracturing process and hinder further fracturing. By having a downhole valve device 1 providing two barriers, such unintentional activation and reservoir 2 access cannot occur independently of the reservoir pressure in a particular zone. In other words, such downhole valve device 1 with both the sleeve 9, the burst element 10 and the acid-dissolvable plugs 11 will not self-activate prematurely and will not hinder the finalising of such fracturing processes.

In FIG. 1A, the downhole completion system 100 further comprises an unexpanded annular barrier 30 comprising a tubular part 31 mounted as part of the well tubular metal structure 21, an expandable metal sleeve 32 connected at each end 33 with an outer face 34 of the tubular part defining an expandable space 35 into which fluid is allowed to expand the expandable metal sleeve 32. When pressurising the well tubular metal structure 21 to expand the expandable metal sleeve 32 of the annular barrier 30, the completion is, in the same way as during fracturing, pressurised to a certain pressure sufficient to expand the expandable metal sleeve 32. If the pressure in the annulus surrounding the downhole valve device 1 is lower than expected due to the low-pressure zone 102, the downhole valve device 1 is then exposed to a larger differential pressure than predicted; however, this does not result in the sleeve 9 being prematurely moved to the second state due to the double barrier of the downhole valve device 1. Thus, the downhole valve device 1 presents a safe valve for providing access to the reservoir 2, even if the reservoir has a depleted zone.

In FIG. 1B, the workstring 40 has been disconnected, and in FIG. 1C the downhole completion system 100 further comprises a production casing 24 having a first end 25 facing a top 51 of the well and a second end 26 connected with the well tubular metal structure 21. As can be seen, the second end 26 of the production casing 24 is connected to the well tubular metal structure 21 below the liner hanger packer 22 and the downhole valve device 1. This is due the fact that the production casing 24, at its second end, is provided with a sleeve actuator 39 which pulls the sleeve 9 of the downhole valve device 1 from the first state, as shown in FIGS. 1A and 1B, to the second state uncovering the through-bores 7, 8 as shown in FIGS. 1C and 1D. The sleeve actuator 39 moves further down and docks in a position below the downhole valve device 1. The sleeve actuator 39 comprises projecting parts 41 for engaging a groove 42 in the sleeve 9 of the downhole valve device 1 in order to move the sleeve 9 of the downhole valve device 1 from the first state to the second state.

After having displaced the sleeve 9 from the first state to the second state, the downhole valve device 1 is pressurised from within, bursting the burst element 10, thus creating flow through the first through-bore 7 as shown by the arrow in FIG. 1D. Thereby, the fluid filling up the completion above the downhole valve device 1 is displaced out through the first through-bore 7 by acid-containing fluid so that the acid arrives at the acid-dissolvable plugs 11 and dissolves the plugs 11, providing flow access also through the second through-bores 8, thus creating a larger flow area for entering of hydrocarbon-containing fluid from the reservoir 2 when the well is put into production. The fluid displaced by means of the acid is thus pressed out of the first through-bore 7 and into the reservoir 2.

FIGS. 2A-2D show another downhole completion system 100 having the downhole valve device 1. In FIG. 2A, the downhole completion system 100 has the same configuration as in FIG. 1A, and as disclosed in FIG. 1B, the annular barrier 30 is then expanded by pressurising the workstring 40 and the well tubular metal structure 21 until the expandable metal sleeve 32 abuts and seals against the inner wall of the borehole as shown in FIG. 2B, and the workstring 40 is disconnected. In FIG. 2B, the downhole completion system 100 comprises the production casing 24 comprising an unexpanded production packer 27 arranged above the liner hanger packer 22 and configured to seal between the production casing 24 within the first casing 23, as shown in FIG. 2C. The production casing 24 comprises a flow device 28 having an opening 29, and before expanding the production packer 27, heavy fluid with a high density and a relatively low viscosity is circulated through the opening 29 out of the well and replaced with some lighter fluid having a lower density (also called base oil displacement) so that production can be initiated later on. Then, the production packer 27 is set to seal between the production casing 24 within the first casing 23, as shown in FIG. 2C. Control lines 36 extend down the well to operate the flow device 28 in order to open or close the opening 29. In FIGS. 2A-2C, a screen 38 is mounted below the annular barrier 30, but in another downhole completion system the configuration below the annular barrier 30 could have a variety of different well designs. A wash-down string may be arranged below the annular barrier 30 in combination with or instead of the screen. In order to expand the annular barrier 30, the well tubular metal structure 21 comprises a closable device 37 so as to close the lower part of the well during the pressurisation. The closable device 37 is shown as a partly cross-sectional view in order to illustrate the closing mechanism inside the closable device 37.

In FIG. 2B, at the second end of the production casing 24, the downhole completion system 100 has the sleeve actuator 39 comprising projecting parts 41, which have engaged the groove 42 in the sleeve 9 of the downhole valve device 1, moving the sleeve 9 of the downhole valve device 1 from the first state to the second state. The sleeve actuator 39 moves further down and docks in a position below the downhole valve device 1, as shown in FIGS. 2B and 2C. After having set the production packer 27, the closable device 37 is still closed, and the downhole valve device 1 is then pressurised from within to burst the burst element 10 and provide flow through the first through-bore 7 as shown in FIG. 2D. Subsequently, the lighter fluid filling up the completion above the downhole valve device 1 is displaced out through the first through-bore 7 by acid-containing fluid so that the acid arrives at the acid-dissolvable plugs 11 and dissolves the plugs, providing flow access also through the second through-bore 8, thus creating a larger flow area for entering of hydrocarbon-containing fluid from the reservoir 2 when the well is put into production. The fluid displaced by means of the acid is thus pressed out of the first through-bore 7 and into the reservoir 2.

FIGS. 1A-1D show a downhole completion method for completing the well 101 having a borehole 103 and the first casing 23 installed in the upper part 20 of the borehole in the reservoir 2 having the low-pressure zone 102 by means of the above-mentioned downhole completion system 100. The downhole completion method comprises assembling the well tubular metal structure 21 having the liner hanger packer 22 and the downhole valve device 1, and then mounting the workstring 40, such as a drill pipe, with the liner hanger packer 22 and inserting the well tubular metal structure 21 into the well 101 through the first casing 23 with the workstring 40, as shown in FIG. 1A. This is performed before setting the liner hanger packer 22 to seal against the first casing 23, pressurising the well tubular metal structure 21, releasing the workstring 40 and pulling the workstring 40 out of the well, as shown in FIG. 1B. Then the method comprises displacing the sleeve 9 of the downhole valve device 1 from the first state to the second state, and uncovering the burst element 10 and the acid-dissolvable plug(s) 11, as shown in FIG. 1C. As shown in FIG. 1D, the method then comprises bursting the burst element 10 by pressurising the well tubular metal structure 21, displacing fluid within at least part of the first casing 23 and within the downhole valve device 1 by means of acid-containing fluid, and out of the first through-bore 7. Then, the downhole completion method comprises dissolving the acid-dissolvable plug(s) 11 and initiating production through the first and second through-bores 7, 8.

The downhole completion method step of pressurising the well tubular metal structure 21 expands an expandable metal sleeve 32 of the annular barrier 30 arranged below the downhole valve device 1, as shown in FIG. 1B. In another downhole completion method, the step of pressurising the well tubular metal structure 21 may be for fracturing the reservoir 2 below the downhole valve device 1 or for stimulating the well, e.g. by acid stimulation.

By having the sleeve 9 of the downhole valve device 1 covering and sealing off the first and second through-bores 7, 8, the acid-dissolvable plugs 11 are also protected during such acid stimulation.

As shown in FIGS. 2A-2D, the downhole completion method further comprises inserting the production casing 24 having the first end 25 closest to a top 51 of the well and the second end 26 within the first casing 23, as shown in FIG. 2B. As the production casing 24 is inserted, the sleeve actuator 39 arranged in the second end 26 of the production casing 24 displaces the sleeve 9 of the downhole valve device 1 from the first state to the second state. Thus, the sleeve actuator 39 and the second end of the production casing 24 pass within the downhole valve device 1, and the projecting parts 41 of the sleeve actuator 39 engage the groove 42 in the sleeve 9. The sleeve actuator 39 is moved further down, disengaging the groove 42 of the sleeve 9 to a position below the downhole valve device 1, but above the annular barrier 30. Above the annular barrier 30, the well tubular metal structure 21 has a decreasing inner diameter, preventing the second end 26 of the production casing 24 from moving further down. Before setting of the production packer, as shown in FIG. 2C, and before bursting the burst element 10, the method further comprises displacing a first fluid, such as heavy fluid, by means of a second fluid, i.e. the lighter fluid having a lower density than that of the first fluid, at least within the first casing 23. After bursting of the burst element 10, the lighter fluid is displaced by means of acid-containing fluid, and the-acid dissolvable plugs 11 are dissolved, providing full access to the reservoir 2 through the through-bores 7, 8 of the downhole valve device 1.

Even though not shown, the sleeve 9 of the downhole valve device 1 may comprise a check valve so that pressure, such as atmospheric pressure, is not trapped between the sleeve 9 and the burst element 10, and the check valve thus prevents fluid from entering the cavity between the sleeve 9 and the burst element 10, but allows flow the other way. The burst element 10 may by a burst disc.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "annular barrier" is meant an annular barrier comprising a tubular metal part mounted as part of the well tubular metal structure and an expandable metal sleeve surrounding and connected to the tubular metal part defining an annular barrier space.

By "casing" or "well tubular metal structure" is meant any kind of pipe, tubing, tubular, liner, string, etc., used downhole in relation to oil or natural gas production.

The movement of the sleeve of the downhole valve device 1 from the first state to the second state may also be performed by a tool. In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described above in connection with preferred embodiments of the invention, it will be evident to a person skilled in the art that several modifications are conceivable without departing from the invention as defined by the following claims.

The invention claimed is:

1. A downhole valve device for providing access to a hydrocarbon reservoir, comprising a tubular element having a wall, an inner face and an outer face, the tubular element having a first through-bore and a plurality of second through-bores in the wall extending from the inner face to the outer face, and a sleeve abutting the inner face and being displaceable along the inner face between a first state in which the sleeve covers the first and second through-bores and a second state in which the sleeve uncovers the first and second through-bores, wherein a pressure-actuated burst element is arranged in the first through-bore and an acid-dissolvable plug is arranged in each second through-bore, wherein, when the valve device is introduced downhole, the sleeve is in the first state such that the sleeve covers the pressure-actuated burst element in the first through-bore and each acid-dissolvable plug arranged in a respective one of the second through-bores, to prevent fluid communication from the inner face to the pressure-activated burst element.

2. A downhole completion system for completing a well in a low-pressure zone, comprising:

a well tubular metal structure, and a liner hanger packer connected to the well tubular metal structure and configured to seal and connect the well tubular metal structure within a first casing, wherein the downhole completion system further comprises a downhole valve device according to claim 1, where the tubular element is mounted as part of the well tubular metal structure.

3. A downhole completion system according to claim 2, further comprising an annular barrier comprising a tubular part mounted as part of the well tubular metal structure, an expandable metal sleeve being connected at each end with an outer face of the tubular part, defining an expandable space into which fluid is allowed to expand the expandable metal sleeve.

4. A downhole completion system according to claim 2, further comprising a production casing having a first end facing a top of the well and a second end connected with the well tubular metal structure.

5. A downhole completion system according to claim 4, wherein the production casing comprises a production packer arranged above the liner hanger packer and configured to seal between the production casing and the first casing within the first casing.

6. A downhole completion system according to claim 4, wherein the second end of the production casing comprises a sleeve actuator for moving the sleeve of the downhole valve device from the first state to the second state.

7. A downhole completion system according to claim 6, wherein the sleeve actuator comprises projecting parts for engaging a groove in the sleeve of the downhole valve device.

8. A downhole completion method for completing a well having a borehole and a first casing installed in an upper part of the borehole in a reservoir having a low-pressure zone, comprising assembling a well tubular metal structure having a liner hanger packer and a downhole valve device according to claim 1, mounting a workstring, such as a drill pipe, with the liner hanger packer, inserting the well tubular metal structure into the well through the first casing with the workstring, setting the liner hanger packer to seal against the first casing, pressurising the well tubular metal structure, releasing the workstring and pulling the workstring out of the well, displacing the sleeve of the downhole valve device from the first state to the second state, uncovering the burst element and the acid-dissolvable plug(s), bursting the burst element by pressurising the well tubular metal structure, displacing fluid within at least part of the first casing and within the downhole valve device by means of acid-containing fluid, dissolving the acid-dissolvable plug(s), and initiating production through the first and second through-bores.

9. A downhole completion method according to claim 8, wherein pressurising the well tubular metal structure expands an expandable metal sleeve of an annular barrier arranged below the downhole valve device.

10. A downhole completion method according to claim 8, further comprising inserting a production casing having a first end closest to a top of the well and a second end within the first casing.

11. A downhole completion method according to claim 10, wherein displacing the sleeve of the downhole valve device from the first state to the second state is performed by a sleeve actuator arranged in the second end of the production casing.

12. A downhole completion method according to claim 11, wherein the sleeve actuator and the second end pass within the downhole valve device, and projecting parts of the sleeve actuator engage a groove in the sleeve.

13. A downhole completion method according to claim 12, wherein the sleeve actuator is moved further down, disengaging the groove of the sleeve.

14. A downhole completion method according to claim 8, wherein before bursting the burst element the method further comprises displacing a first fluid by means of a second fluid having a lower density than that of the first fluid, at least within the first casing.

15. A downhole completion method according to claim 14, wherein after displacing the first fluid by means of the second fluid the method further comprises setting a production packer.

* * * * *